US005898131A

United States Patent [19]

Chadbourne et al.

[11] Patent Number: 5,898,131

[45] **Date of Patent: *Apr. 27, 1999**

[54] TWISTED H-SHAPED ELECTRICAL CONNECTOR

[75] Inventors: Richard Chadbourne, Merrimack; Daniel David Dobrinski, Epping; William J. Lasko, Littleton; Gary E. Schrader, Londonderry, all of N.H.

[73] Assignee: Framatome Connectors USA, Inc., Fairfield, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,371

[22] Filed: Oct. 30, 1996

[51] Int. Cl.[6] ..... H01R 4/00

[52] U.S. Cl. ..... 174/84 C; 174/94 R

[58] Field of Search ..... 174/94 R, 84 C, 174/40 CC; 403/275, 391; 439/877; 191/23 A, 33 R

[56] References Cited

U.S. PATENT DOCUMENTS

| | | | |
|---|---|---|---|
| D. 187,531 | 3/1960 | Klosin | D13/149 |
| 416,289 | 12/1889 | Ellinwood | 191/33 R |
| 683,672 | 10/1901 | Wellman | 403/396 |
| 2,307,216 | 1/1943 | Graham | 174/84 C |
| 2,760,798 | 8/1956 | Evans | 403/398 |
| 3,183,025 | 5/1965 | Lynch, Jr. et al. | 403/390 |
| 3,255,565 | 6/1966 | Menzel | 52/678 |
| 4,302,124 | 11/1981 | Wilks et al. | 403/391 |
| 4,405,827 | 9/1983 | Mixon, Jr. | 174/94 R |
| 4,942,757 | 7/1990 | Pecora | 72/453.16 |
| 5,162,615 | 11/1992 | Schrader et al. | 174/94 R |
| 5,200,576 | 4/1993 | Schrader et al. | 174/94 R |
| 5,477,680 | 12/1995 | Heskey et al. | 60/452 |

FOREIGN PATENT DOCUMENTS 251253 12/1966 Germany .

OTHER PUBLICATIONS

1. Burndy Electrical, "Hyground Systems Installation Procedure", Framatome Connectors International, pp. 2,3,11–15, 1995.

*Primary Examiner*—Nestor Ramirez
*Assistant Examiner*—Joseph Waks
*Attorney, Agent, or Firm*—Perman & Green, LLP

[57] ABSTRACT

An electrical connector with a first U-shaped section and a second section. The first and second sections each have a conductor receiving channel. The channels have center axes that extend along parallel planes, but are angled relative to each other. One embodiment has the second section with a U-shape orientated generally reverse to the first section and sharing a common bottom. A set of compression dies are provided to allow the first and second sections to be compressed onto respective conductors at the same time.

15 Claims, 4 Drawing Sheets

TWISTED H-SHAPED ELECTRICAL CONNECTOR

BACKGROUND OF THE INVENTION

1. Field Of The Invention

The present invention relates to electrical connectors and, more particularly, to a connector for connecting two conductors to each other at the same time.

2. Prior Art

The Burndy Electrical division of Framatome Connectors USA Inc. sells various different types of electrical connectors that are attached to conductors by hydraulic compression tools. In order to connect perpendicular crossing grounding conductor lines to each, a Burndy type YGL-C cross connector is used which requires two compressions at separate ends of the connector. The YGL-C cross connector has an L-shaped bar section between its two connection ends. U.S. Pat. No. 5,162,615 discloses an H-shaped connector.

SUMMARY OF THE INVENTION

In accordance with one embodiment of the present invention an electrical connector is provided comprising a first section and a second section. The first section has a first conductor receiving channel. The second section has a second conductor receiving channel. The second channel is angled relative to the first channel at an angle of between 20 degrees and 90 degrees. The first and second sections are orientated generally reverse to each other with a bottom of the first section being connected to a bottom of the second section.

In accordance with another embodiment of the present invention an electrical connector is provided comprising a first section and a second section. The first section has a general U shape. The first general U shape forms a first conductor receiving channel. The second section also has a general U shape. The second general U shape forms a second conductor receiving channel. The second section is connected to the first section and is generally reversely orientated relative to the first section. The first and second sections are angularly offset relative to each other to form a general twisted H shape.

In accordance with another embodiment of the present invention a compression tool die set is provided comprising a first die and a second die. The first die has a first article contact surface with a first receiving area for a connector. The first receiving area has a first longitudinal axis. The second die has a second article contact surface with a second receiving area for the connector. The second receiving area has a second longitudinal axis. When the first and second dies are mounted in a compression tool with the first and second article contact surfaces facing each other, the first and second longitudinal axes are angled relative to each other.

In accordance with one method of the present invention a method of connecting a first electrical conductor to a second electrical conductor is provided comprising steps of positioning a connector into a compression tool, the connector having a first conductor receiving channel and a second conductor receiving channel, the first channel being angled relative to the second channel; positioning the first conductor in the first receiving channel and the second conductor in the second receiving channel; and compressing the connector onto the first and second conductors at the same time, wherein the connector has a first section that is compressed about a longitudinal axis of the first receiving channel onto the first conductor and a second section that is compressed about a longitudinal axis of the second receiving channel onto the second conductor.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
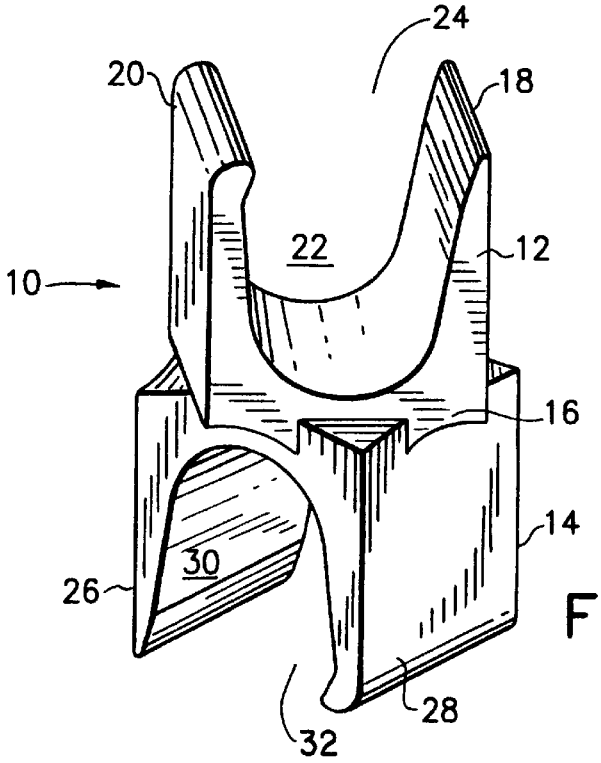
FIG. 1 is a perspective view of an electrical connector incorporating features of the present invention.

Referring to FIG. 1, there is shown a perspective view of an electrical connector 10 incorporating features of the present invention. Although the present invention will be described with reference to the embodiments shown in the drawings, it should be understood that features of the present invention can be embodied in various different forms of alternate embodiment. In addition, any suitable size, shape or type of materials or elements could be used.

Figure 2:
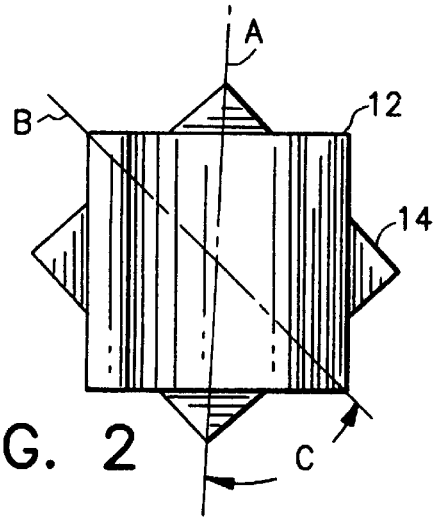
FIG. 2 is a top plan view of the connector shown in FIG. 1.

The connector 10 is a one-piece member made of electrically conductive material, such as copper, aluminum or brass. The connector 10 has a first section 12 and a second section 14. The first section 12 has a bottom 16 and two walls 18, 20 extending from the bottom 16. The first section 12 has a conductor receiving channel 22 formed between the two walls 18, 20 with an open top 24. Thus, the first section 12 has a general U-shape. The second section 14 is substantially the same as the first section 12. The first section 12 shares the bottom 16 with the second section 14. Therefore, the bottom 16 is a common bottom to both the first section 12 and the second section 14. The second section 14 has two walls 26, 28, a conductor receiving channel 30, and an open top 32 to form a general U-shape similar to the first section 12. However, the first and second sections are orientated generally reverse to each other. In addition, as seen with further reference to FIG. 2, the first and second sections 12, 14 are angled relative to each other. The conductor receiving channel 22 of the first section 12 has a center axis A. The conductor receiving channel 30 of the second section 14 has a center axis B. The two channels 22, 30 are angled relative to each other as indicated by angle C. Angle C can be between about 20° to about 90°. In a preferred embodiment angle C is about 42°. However, any suitable angle could be provided. The connector 10 gives the impression of having a twisted H-shape; twisted in the middle of the H-shape only. The two lateral sides of the H-shape are formed by the walls 18, 20 of the first section 12 and the walls 26, 28 of the second section 14. One wall 18 of the first section 12 and the corresponding adjoining wall 28, of the second section 14 form one lateral side of the H-shape and the other wall 20, of the first section 12 with the corresponding adjoining wall 26 of the second section form the second lateral side of the H-shape. Hence, each lateral side of the H-shape is twisted in the middle of the H-shape as a result of the relative angle of the walls 18, 20 to the corresponding respective adjoining walls 28, 20.

Figure 3:
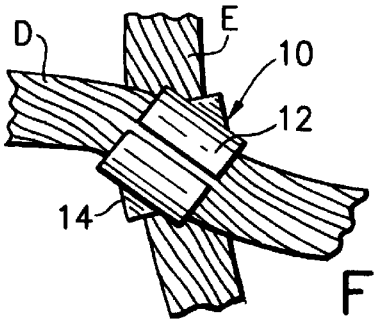
FIG. 3 is a top plan view of the connector shown in FIG. 1 attached to two conductors.

Referring also to FIG. 3, the connector 10 is shown attached to two electrical conductors D, E. The conductors D, E are electrical cables, such as those used in building grounding grid systems. The conductors D, E are laid out generally perpendicular to each other. In order to connect the connector 10, the conductors D, E are slightly zig-zaged through the channels 22, 30, but otherwise would be perpendicular to each other. The connector 10 can also obviously connect crossing conductors that are not generally perpendicular. The first section 12 is connected to the first conductor D. The first section 12 is crimped or compressed into the conductor D to fixedly and stationarilly connect the connector 10 to the first conductor D. More specifically, the first conductor D is located in the first channel 22 and the two walls 18, 20 have been deformed or bent around and onto the first conductor D. The second section 14 is similarly connected to the second conductor E. More specifically, the second section 14 is crimped onto the second conductor E with the conductor E located in the second channel 30 and the two walls 26, 28 being deformed or bent around and onto the second conductor E. Thus, the connector 10 both electrically and mechanically connects the crossing conductors D, E to each other. The open tops 24, 32 allow the conductors to be laid out and the connector 10 then subsequently attached where the conductors cross each other. This eliminates having to snake the conductors D, E through closed channels of a connector. The one-piece nature of the connector 10 is less expensive to manufacture than the old multipiece crossing conductor connectors. In addition, unlike old multipiece crossing conductor connectors that required two separate compression operations to be connected to the two conductors, the connector 10 can be connected to both conductors D, E at the same time with only one compression operation. This can obviously save installation time.

Figure 4:
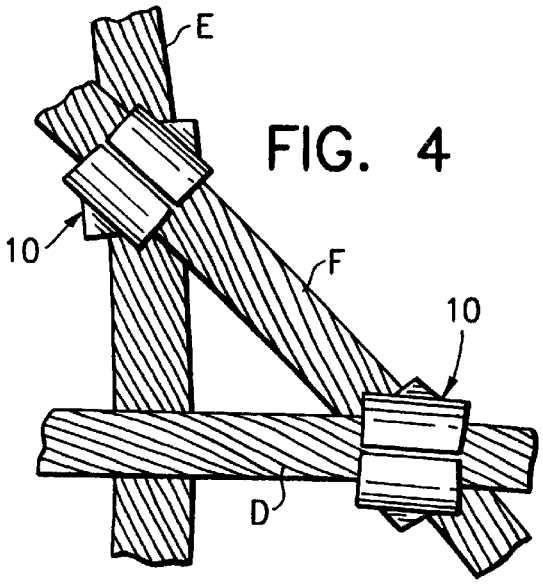
FIG. 4 is a top plan view of two of the connectors shown in FIG. 1 connected to three conductors.

Referring now also to FIG. 4, two of the connectors 10 are shown connected to three conductors D, E, F. This embodiment is intended to illustrate use of the connectors 10 in two other types of use other than that shown in FIG. 3. If the connectors D, E are two rigid to be zig-zaged into a single one of the connectors 10, or bending of the conductors is otherwise unwanted or not possible, the third conductor F can be used to connect the conductors D, E to each other with the use of the two connectors 10. In such a use, the conductor F could merely be a short piece of extra or otherwise scrap cable. In another situation, the conductor F could be part of a ground grid system in an adjacent room; the two grids being angularly offset from each other. However, the conductor F is electrically connected to both the conductors D, E; and the conductors D, E are electrically connected to each other by the conductor F. Other interconnection possibilities could also be provided.

Figure 5:
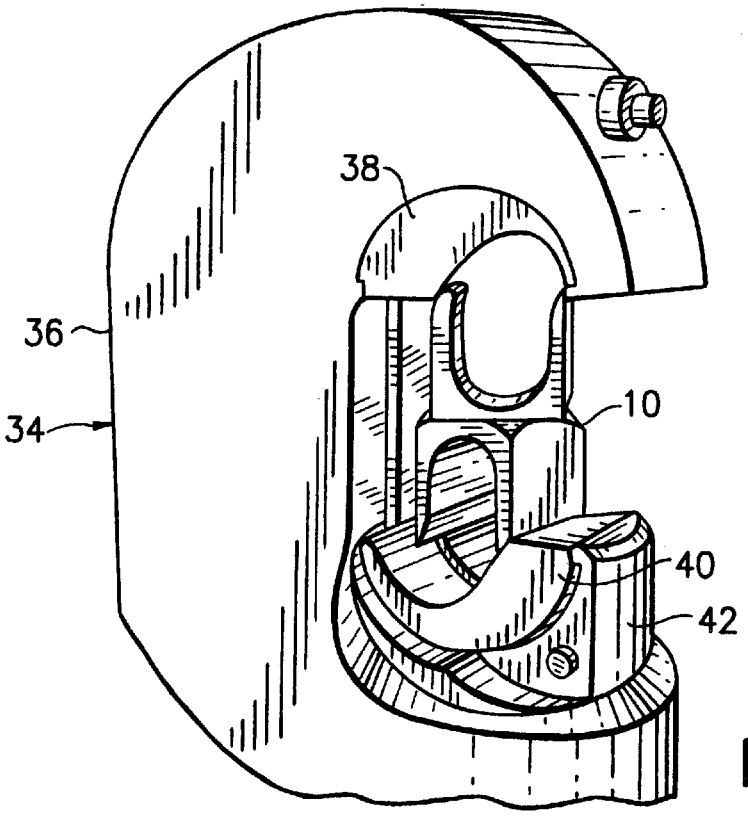
FIG. 5 is a perspective view of the connector shown in FIG. 1 located in a compression tool.
Figure 6:
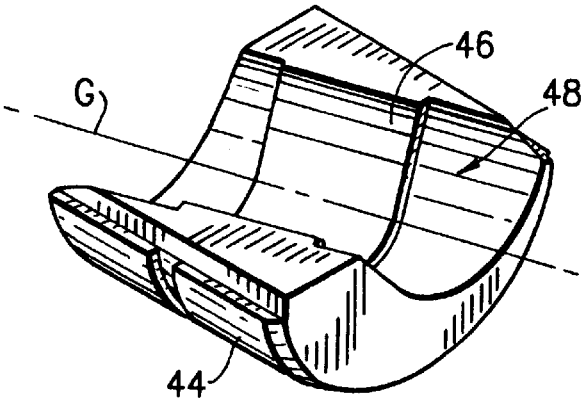
FIG. 6 is a perspective view of one of the die used in the tool shown in FIG. 5.

Referring now to FIG. 5, a perspective view of the connector 10 is shown in the working head of a compression tool 34. The tool 34 is preferably a hydraulically driven tool such as disclosed in U.S. Pat. Nos. 4,942,757; 5,477,680; or 5,113,679. However, any suitable type of compression tool could be used. In the embodiment shown, the head 36 of the tool has a general C-shaped frame and a compression tool die set with a first tool die 38 and a second tool die 40. The dies 38, 40 are removably mounted to the tool 34. The tool 34 has a ram 42 that can be moved by hydraulic pressure to move the second die 40 towards the first die 38. In the embodiment shown, the two dies 38, 40 are identical to each other. They are merely positioned opposite each other in the tool 34 in a reverse minor image orientation. However, in alternate embodiments, the two dies could be different from each other. Referring also to FIG. 6, a perspective view of an individual one of the dies is shown. The die is a one piece metal member with a first surface 44 and a second surface 46. The first surface 44 is suitably sized and shaped to be positioned in a receiving pocket of either the frame 36 or the ram 42. The second surface 46 is a connector contact surface. The connector contact surface 46 forms a receiving area 48 for the connector 10. The receiving area 48 has a longitudinal axis G. The longitudinal axis G of the receiving area 48 is angled relative to the side ends of the die. In the embodiment shown, the longitudinal axes G are angled relative to their respective die side ends at an angle of about 21°. Due to the fact that the two dies 38, 40 are reversely orientated relative to each other in the tool 34, the two longitudinal axes G are angled relative to each other. With the reverse positioning of the two dies 38, 40, the two longitudinal axes G are angled relative to each other at an angle of about 42°. However, in alternate embodiments, other suitable angles could be provided, such as an angle of between about 40° to 50°. Because the angle C (see FIG. 2) in the connector 10 is 42°, the connector 10 has the ends of its walls 18, 20, 26, 28 seat nicely against the connector contact surfaces 46 of the dies 38, 40. Of course, for connectors with different shapes, the dies can be appropriately configured. Before the connector is compressed, the two conductors are placed in the channels 22, 30 (see FIG. 1). This could be before or after the connector 10 is positioned in the tool 34. As the ram 42 is moved to moved the two dies 38,40 closer together, the walls 18, 20, 26, 28 are deformed inward and towards the receiving channels 22, 30 to compress or crimp the connector onto the conductors in the channels. The angled shapes of the receiving areas 48 are necessary to get a uniform and predictable deformation of the walls 18, 20, 26, 28 about the axes A, B of the channels 22, 30.

Figure 7:
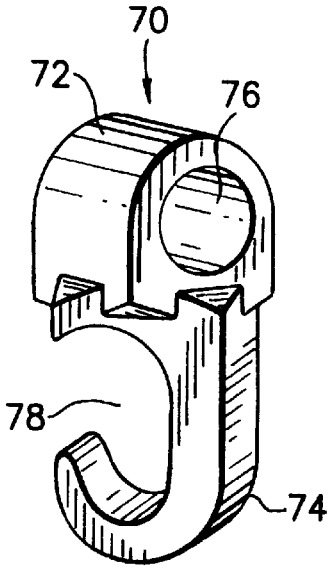
FIG. 7 is a perspective view of an alternate embodiment of the present invention.

Referring now to FIGS. 7–10 alternate embodiments of one-piece connectors incorporating features of the present invention will be described. FIG. 7 shows a connector 70 with a first section 72 and a second section 74. The first section 72 has an enclosed channel 76. The second section 74 has a general C-shape. The channel 76 and the channel 78 formed by the C-shape have center axes that are angled relative to each other. This embodiment allows the first section 72 to be axially slid onto a first conductor and a second conductor can be placed in the channel 78 of the second section 74 by passage through the open side.

Figure 8:
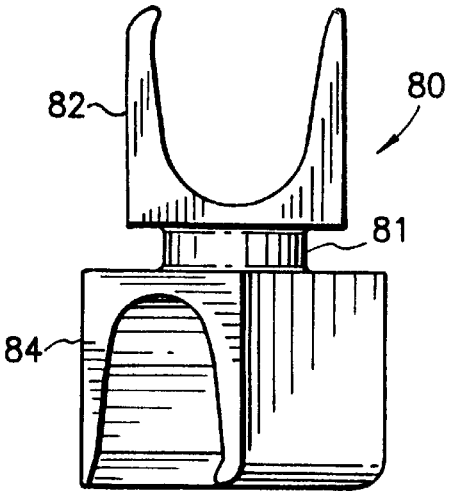
FIG. 8 is an elevational side view of an alternate embodiment of the present invention.

FIG. 8 shows a connector 80 very similar to the connector 10. However, the connector 80 has a bridge section 81 that connects the U-shaped first section 82 to the U-shaped second section 84. This embodiment could allow non-twisted general H-shaped connectors to be formed with the bridge section 81 and, if a twisted general H-shaped connector was desired, the two sections 82, 84 could be twisted relative to each other. The bridge section 81 could deform to provide the twisted general H-shape. Thus, only one set of connector forming dies need be used to form two different types of connectors; twisted H-shape and non-twisted H-shape. The angle of twist could also be easily varied as desired.

Figure 9:
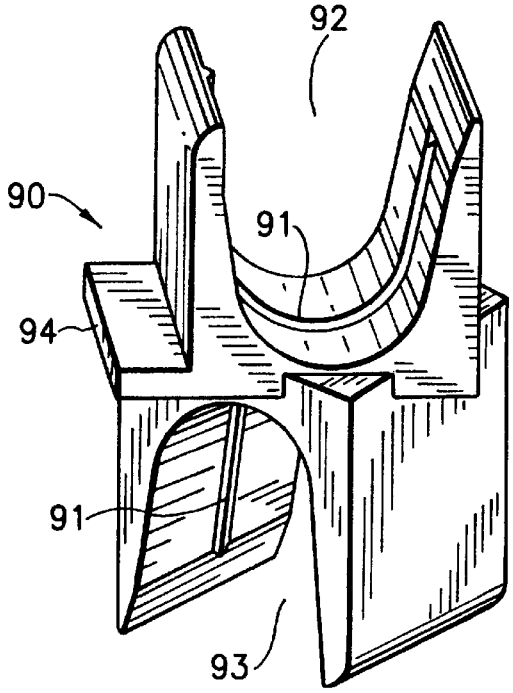
FIG. 9 is a perspective view of an alternate embodiment of the present invention.

FIG. 9 shows a connector 90 similar to the connector 10. However, the connector 90 includes ribs 91 in the conductor receiving channels 92, 93 and a side extension 94. The ribs 91 are provided to enhance griping of the connector 90 on the conductors. In alternate embodiments, other suitable gripping means could be used. The side extension 94 is provided as an easily identifiable location to provide marking indicia, such as conduct size and type for which it is appropriate to use the connector. However, any suitable type of marking indicia or marking location could be used.

Figure 10:
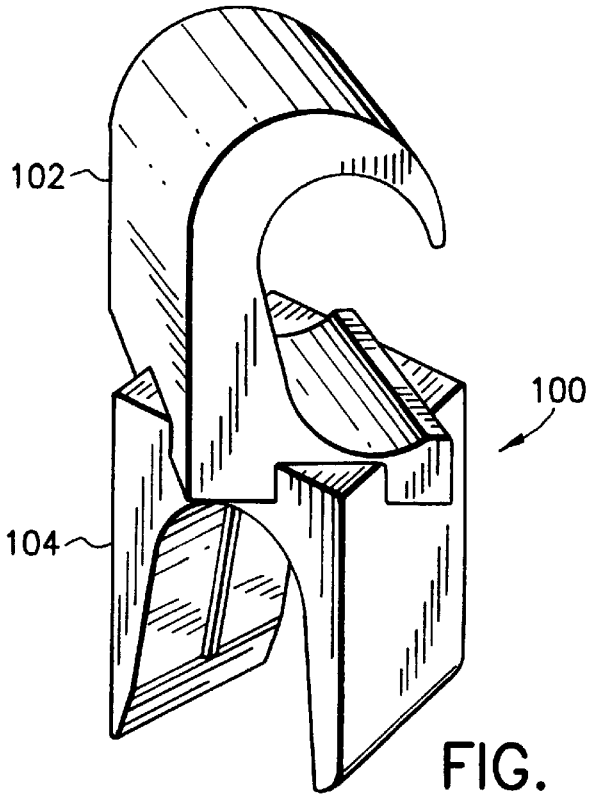
FIG. 10 is a perspective view of another alternate embodiment of the present invention.
Figure 11:
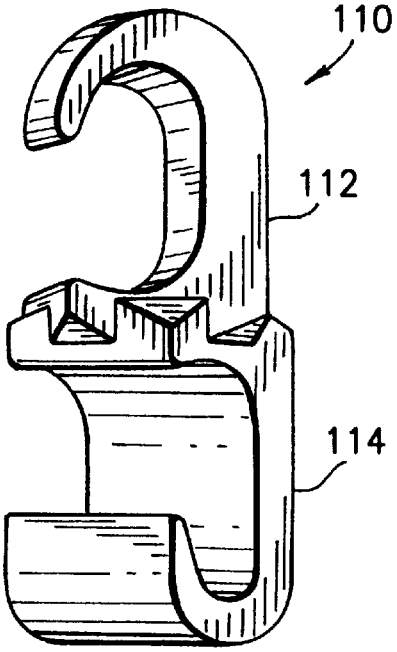
FIG. 11 is a perspective view of another alternate embodiment of the present invention.
Figure 12:
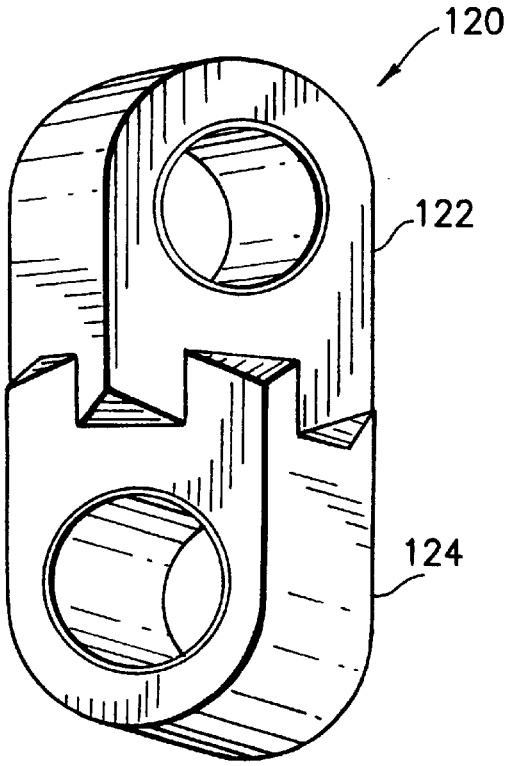
FIG. 12 is a perspective view of another alternate embodiment of the present invention.

FIG. 10 shows a connector 100 with an C-shaped first section 102 and an angled U-shaped second section 104. FIG. 11 shows a connector 110 with two C-shaped sections 112, 114. The two sections 112, 114 share a common base and are angled relative to each other such that their respective conductor receiving areas are angled relative to each other. FIG. 12 shows a connector 120 with two closed or 0-shaped sections 122, 124. The two sections 122, 124 share a common base and are angled relative to each other such that their respective conductor receiving areas are angled relative to each other. It should be obvious from all of the embodiments described above that there could be numerous combinations of different types of first and second sections. However, the present inventions resides in the angled nature of the first and second sections relative to each other and, the one-compression operation for connecting the connector to two crossing conductors.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a frame with a first conductor receiving channel and a second conductor receiving channel; and means for crimping conductors in the corresponding receiving channels to the frame in a single stroke, wherein the means for crimping comprise the frame having a first section with the first conductor receiving channel formed therein, and the frame having a second section with the second conductor receiving channel formed therein, the second channel being angled relative to the first channel at an angle of between 20° and less than 90°, and wherein the first and second sections are orientated generally reverse to each other with a bottom of the first section being connected to a bottom of the second section.

2. A connector as in claim 1 wherein the first section has a general U-shape.

3. A connector as in claim 2 wherein the second section has a general U-shape.

4. A connector as in claim 3 wherein the first and second sections share a common bottom such that the connector has a twisted H-shape.

5. A connector as in claim 2 wherein the second section has a general C-shape.

6. A connector as in claim 1 wherein the connector has a bridge section connecting the bottom of the first section to the bottom of the second section and, the first and second sections are aligned in a common axis with the bridging section.

7. A connector as in claim 1 wherein the angle is about 42°.

8. A connector as in claim 1 wherein the connector is comprised of a single piece of electrically conductive metal.

9. A connector as in claim 8 further comprising a laterally extending rib at a junction of the bottoms of the first and second sections to each other, the rib having an identifying marking thereon.

10. An electrical connector comprising:

a first section with a first general U-shape, the first general U-shape forming a first conductor receiving channel; and a second section with a second general U-shape, the second general U-shape forming a second conductor receiving channel, the second section being connected to the first section and being generally reversely orientated relative to the first section, wherein the first and second sections are angled relative to each other at an angle of less than 90° to form a general twisted H-shape.

11. A connector as in claim 10 wherein the connector is comprised of a one-piece metal member.

12. A connector as in claim 10 wherein the first and second sections are angled relative to each other at an angle of between about 40° to about 50°.

13. A connector as in claim 10 wherein a bottom of the first section is directly connected to a bottom of the second section.

14. A connector as in claim 10 wherein the first and second sections are aligned along a common center axis.

15. An electrical connector as in claim 10, wherein the general twisted H-shape has two generally twisted outer sides, each of said outer sides comprising a first external planar portion and a second external planar portion crossing over the first external planar portion at an angle to the first external planar portion.

* * * * *